United States Patent [19]

Harmon

[11] 4,121,079

[45] Oct. 17, 1978

[54] MINIMIZING LAMP FLICKER AND BLOWER SPEED VARIATION IN A MICROWAVE OVEN EMPLOYING DUTY CYCLE POWER LEVEL CONTROL

[75] Inventor: Larry R. Harmon, Jeffersontown, Ky.

[73] Assignee: General Electric Company, Louisville, Ky.

[21] Appl. No.: 790,582

[22] Filed: Apr. 25, 1977

[51] Int. Cl.[2] ..... H05B 9/06

[52] U.S. Cl. ..... 219/10.55 B; 323/58; 323/60

[58] Field of Search ..... 219/10.55 B; 323/6, 323/45, 57, 58, 60

[56] References Cited

U.S. PATENT DOCUMENTS

| | | | |
|---|---|---|---|
| 3,514,566 | 5/1970 | Ironfield | 219/10.55 B |
| 3,614,595 | 10/1971 | Paulden | 323/6 |
| 3,710,065 | 1/1973 | Crapuchettes | 219/10.55 B |
| 3,824,365 | 7/1974 | Tapper | 219/10.55 B |
| 3,842,233 | 10/1974 | Lamb | 219/10.55 B |
| 3,943,317 | 3/1976 | Nagamoto | 219/10.55 B |
| 3,967,156 | 6/1976 | Levie | 315/101 |
| 4,041,267 | 8/1977 | Wechsler | 219/10.55 B |

OTHER PUBLICATIONS

Radio Amateur's Handbook, 45 edition, p. 325, copyright 1968, American Radio Relay League, Inc.

*Primary Examiner*—J. V. Truhe
*Assistant Examiner*—Bernard Roskoski
*Attorney, Agent, or Firm*—Steven C. Schnedler; Francis H. Boos

[57] ABSTRACT

A microwave oven circuit includes a magnetron power transformer and a duty cycle controlled switching element connected to periodically energize the power transformer from an AC power source. Due to the effects of power source loading, the available AC voltage drops during those intervals when the power transformer is energized. This undesirably causes cyclical variation in the operation of certain constantly energized load devices such as the oven lamp and the motor for the blower which provides cooling air for the magnetron. To minimize the undesirable voltage variation, a low voltage secondary winding on the magnetron power transformer is connected in series with the constantly energized load device and properly phased to provide a voltage boost upon energization of the power transformer. Preferably, the low voltage secondary winding is an otherwise unused winding originally intended to be a magnetron filament winding. As a result, very little additional cost is involved.

5 Claims, 2 Drawing Figures

MINIMIZING LAMP FLICKER AND BLOWER SPEED VARIATION IN A MICROWAVE OVEN EMPLOYING DUTY CYCLE POWER LEVEL CONTROL

BACKGROUND OF THE INVENTION

1. Field of the Invention

The present invention relates generally to a microwave oven of the type including a duty cycle control to vary power level and, more particularly, to a means for minimizing the lamp flicker and blower motor speed variation which occurs in such an oven as the duty cycle control alternately energizes and de-energizes the magnetron power transformer and causes the available AC line voltage to vary.

2. Description of the Prior Art

A frequently employed method for varying the cooking power level in a microwave oven is duty cycle control. In the operation of a duty cycle control, the power transformer and the magnetron are alternately switched between a full-on condition and a full-off condition. The percentage of "on" time compared to the total time of each timing period is known as the duty cycle. The average power level is a direct function of the duty cycle. Various specific circuits have been employed to effect duty cycle power level control. These range from a simple cam-operated mechanical timer having electrical contacts arranged in series with the primary of the power transformer, to more sophisticated systems employing electronic solid state timing and switching elements.

A drawback to duty cycle power level control results from the effect of the drastically varying load on the AC power source as the power level control cycles the power transformer and magnetron "on" and "off". Most consumer countertop microwave ovens are operated from a standard 120 volt, 15 or 20 amp household branch circuit. The load which the power transformer and the magnetron present is approximately 1500 watts, which is relatively large. When this load is effectively connected across the line, the available voltage drops approximately 3 volts. This is of course subject to variation between individual houses and individual branch circuits, depending for example upon such variables as wire size, length of the conductor supplying the branch circuit, and "stiffness" of the voltage supplied by the power company to the house.

In addition to the power transformer and magnetron there are other devices within the microwave oven which are supplied from the AC power source. Some of these devices are constantly energized while the oven is operating. These include such devices such as an oven lamp used to illuminate the interior of the cooking cavity and a blower motor used to provide cooling air for the magnetron. Such devices are adversely affected by the cyclical variation in available voltage to the extent that they become a subtle annoyance to a user of the oven. The lamp flickers in a cyclical manner and the blower motor rotational speed varies to produce a rhythmical variation in audible sound. These effects are particularly noticeable when a solid state duty cycle power level control is employed which typically has a short timing period, in the order of one or two seconds. The effects are present but less noticeable when a mechanical duty cycle timer is employed, as these devices typically have a timing period in the order of thirty seconds.

By the present invention there is provided a microwave oven circuit which minimizes the above-described effects on constantly energized devices within the microwave oven to the extent that such effects are a result of voltage variations caused by cyclical loading and unloading of the power source as the power level control energizes and de-energizes the power transformer and magnetron.

SUMMARY OF THE INVENTION

It is therefore an object of the invention to provide a circuit for minimizing lamp flicker and blower speed variations in a microwave oven of the type employing duty cycle power level control.

It is another object of the invention to provide such a circuit which is effective yet extremely low in cost.

In accordance with the invention, a low voltage secondary winding on the power transformer is connected in series with a means which is constantly energized and which includes one or more load devices. The low voltage secondary winding is properly phased to provide a voltage boost to the constantly energized means upon energization of the power transformer. The voltage boost approximately compensates for the drop in available AC voltage so that variations in voltage across the constantly energized means are minimized. The constantly energized means may include the oven lamp or blower motor referred to above, or both. Additionally it may include a separate magnetron filament transformer, for which it is also desirable to minimize voltage variations.

Preferably, the low voltage secondary winding is an unused winding which was originally intended to supply the magnetron filament. Since the use of many solid state power level controllers requires that a separate constantly energized magnetron filament transformer be employed, oftentimes the filament winding provided on the magnetron power transformer is unused. Thus the present invention with its resultant advantage may be employed at a very minimal additional cost. One particular magnetron power transformer may be stocked for many different microwave oven models having different optional features, such as solid state variable power level control. The power transformer filament winding is thus needed for some models and not for others. Due to the relatively low cost of providing such a filament winding, the economy associated with stocking only a single power transformer type may outweigh the added expense in providing some power transformers with the filament winding and some without. The result is that in some circumstances the present invention may be employed with essentially no increased cost. It will be apparent that this is an important consideration in a product designed for the mass consumer market. Even if transformers with an unused winding would not normally be stocked, the additional cost to do so is not substantial in view of the significant advantage afforded by the invention.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENT

Figure 1:
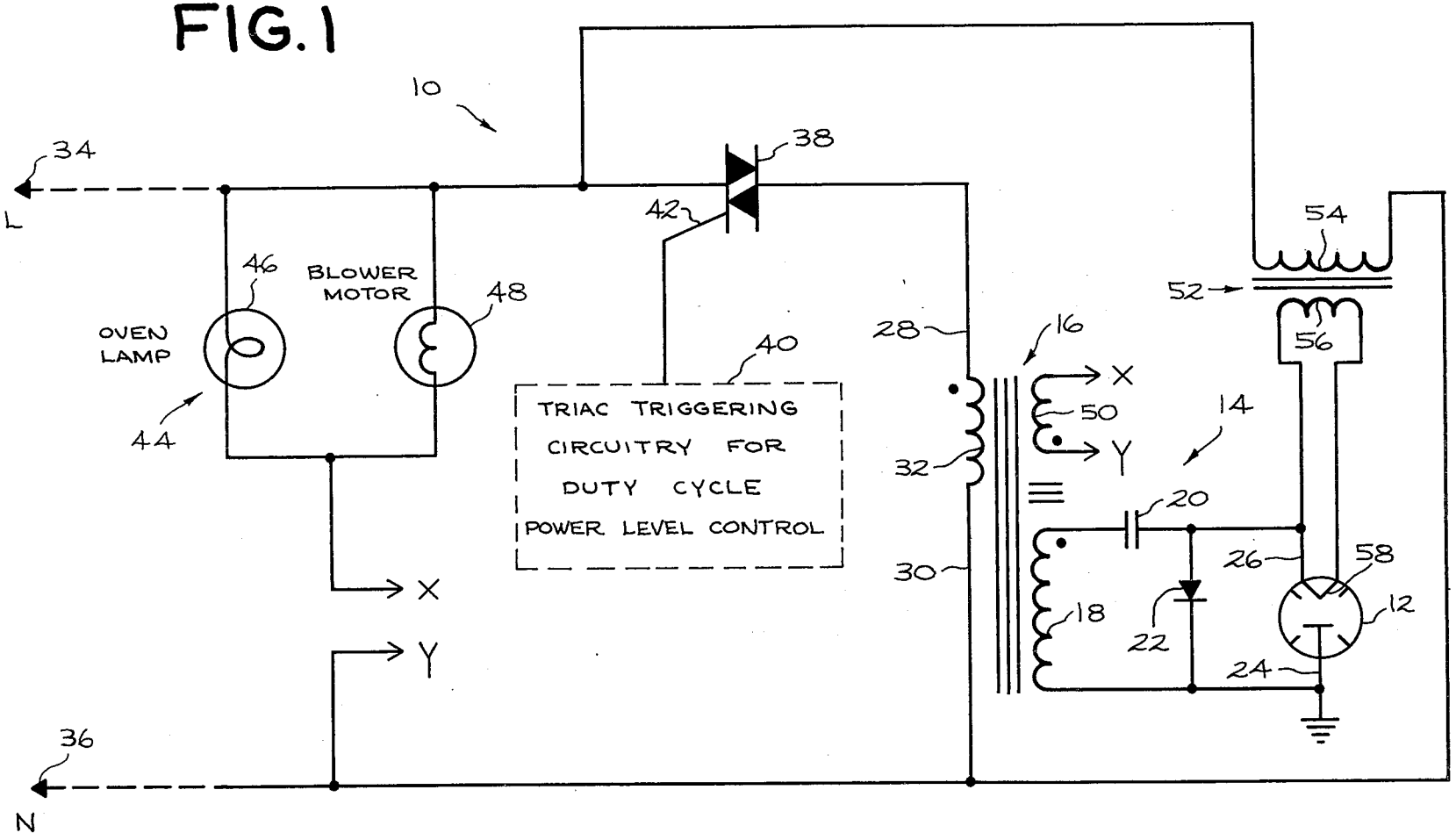
FIG. 1 is a simplified schematic circuit diagram of a microwave oven illustrating the general principles of the invention.

Referring first to FIG. 1, a simplified microwave oven circuit 10 includes a magnetron 12 which generates cooking microwaves when energized from a suitable high voltage DC source. A magnetron power supply 14 includes a power transformer 16 having a high voltage secondary winding 18 connected to energize the magnetron 12 through a half-wave voltage doubler comprising a series capacitor 20 and a rectifying diode 22 connected across the magnetron anode and cathode terminals 24 and 26, respectively, and oppositely poled with respect thereto.

Terminals 28 and 30 of the power transformer primary winding 32 are connected to "L" and "N" terminals 34 and 36 which are in turn connected to an AC power source, such as a 120 volt, 20 amp household branch circuit. To control the average power level, a duty cycle controlled switching element is interposed between the "L" power source terminal 34 and the primary winding terminal 28 to periodically energize the power transformer 16 and the magnetron 12 from the AC power source. The particular duty cycle controlled switching element illustrated is a triac 38 having suitable triggering circuitry 40 connected to its gate terminal 42. However, it will be apparent that other controlled switching elements may be employed, such as relay contacts and cam operated switches.

In operation, as the triac 38 alternately energizes and de-energizes the power transformer 16, the voltage available across the "L" and "N" AC power source terminals 34 and 36 drops slightly during those intervals when the power transformer 16 is energized and loads the power source.

Additionally connected across the "L" and "N" power source terminals 34 and 36 is a means, generally designated at 44, which includes at least one load device and which is energized constantly from the AC power source during those periods when the microwave oven is operating. The constantly energized means 44 includes load devices such as an oven lamp 46 and a blower motor 48 for which it is desirable to minimize voltage variations for the reasons mentioned in the "Background of the Invention."

In accordance with the invention, a low voltage secondary winding 50 on the power transformer 16 is connected in series with the constantly energized means 44. The connection to the secondary winding 50 is schematically shown as "X" and "Y" for convenience. As indicated by the heavy dots near the ends of the transformer windings, this connection is properly phased to provide a voltage boost to the constantly energized means 44 upon energization of the power transformer 16.

The low voltage secondary winding 50 is an otherwise unused winding which supplies 3.3 volts AC and which was originally intended to be a magnetron filament winding. This voltage is the approximate amount required in most cases to provide the necessary compensation for the drop in available AC voltage when the power transformer 16 and the magnetron 12 are energized. It will be appreciated that in many cases 3.3 volts is not the precise voltage boost required. Nevertheless, it is a good average. It will be further appreciated that in practically every case there will be substantial improvement, even though the voltage variation is not exactly compensated for. For example, if for a particular household branch circuit there is a drop of 4.3 volts under load, then when the present invention is employed, the reduction in voltage supplied to the constantly energized means 44 is only one volt. As another example, if the household branch circuit is fairly stiff and suffers only a 2.3 volt drop under load, then when the present invention is employed, the voltage supplied to the constantly energized means 44 increases by one volt. Although this amounts to overcompensation, the net change in voltage is still less than before. In substantially all cases, the change in voltage supplied to the constantly energized means as a result of the operation of the duty cycle power level control is minimized.

Since the low voltage secondary winding 50 is a part of the power transformer 16, the voltage boost to the constantly energized means 44 occurs automatically. It is the energization of the power transformer 16 which causes the drop in available voltage across the "L" and "N" terminals 34 and 36. Thus it is precisely when the boost is needed that the boost is available. During those periods when the power transformer 16 is not energized, the voltage drop across the secondary winding 50 is rather insignificant, in the order of thirty millivolts, as the impedance of the low voltage secondary winding 50 is relatively low.

Still referring to FIG. 1, a separate filament transformer 52 has a primary winding 54 connected across the "L" and "N" power source terminals 34 and 36, and a secondary winding 56 connected to supply the magnetron filament 58. It is necessary to provide the separate filament transformer 52 to maintain the filament 58 constantly energized during those periods when the power transformer 16 is de-energized. With the relatively short timing period (approximately 1 or 2 seconds) associated with a solid state duty cycle power level control, unsatisfactory operation of the magnetron 12 would result if its filament supply were interrupted at such a rate.

This necessity to provide the separate filament transformer 52 when the solid state duty cycle power level control is employed leads to an important advantage of the present invention when applied to certain ovens, namely its low cost aspect. It makes available the low voltage secondary winding 50 in the power transformer, which as stated above, was originally intended as a magnetron filament winding and which would be unused but for the present invention. It will thus be appreciated that in some cases the important advantages afforded by the invention can be provided essentially at no additional cost.

When the mechanical cam operated type of duty cycle power level control is employed, which typically has approximately a thirty second timing period, the magnetron filament is usually supplied by a winding on the power transformer and the magnetron is "cold switched." ("Cold switched" means that the magnetron filament voltage and the magnetron high voltage are applied at the same time, with no prior filament warmup.) The present invention is applicable to such a microwave oven which does not include a separate filament transformer. However, in this instance the low cost aspect of the invention is partially lost due to the necessity of either providing an additional low voltage winding on the power transformer 16 or providing a separate filament transformer. As pointed out above, this disadvantage does not occur when a solid state power level control having a relatively short timing period is employed because in that instance a separate magnetron filament transformer is required anyway.

Figure 2:
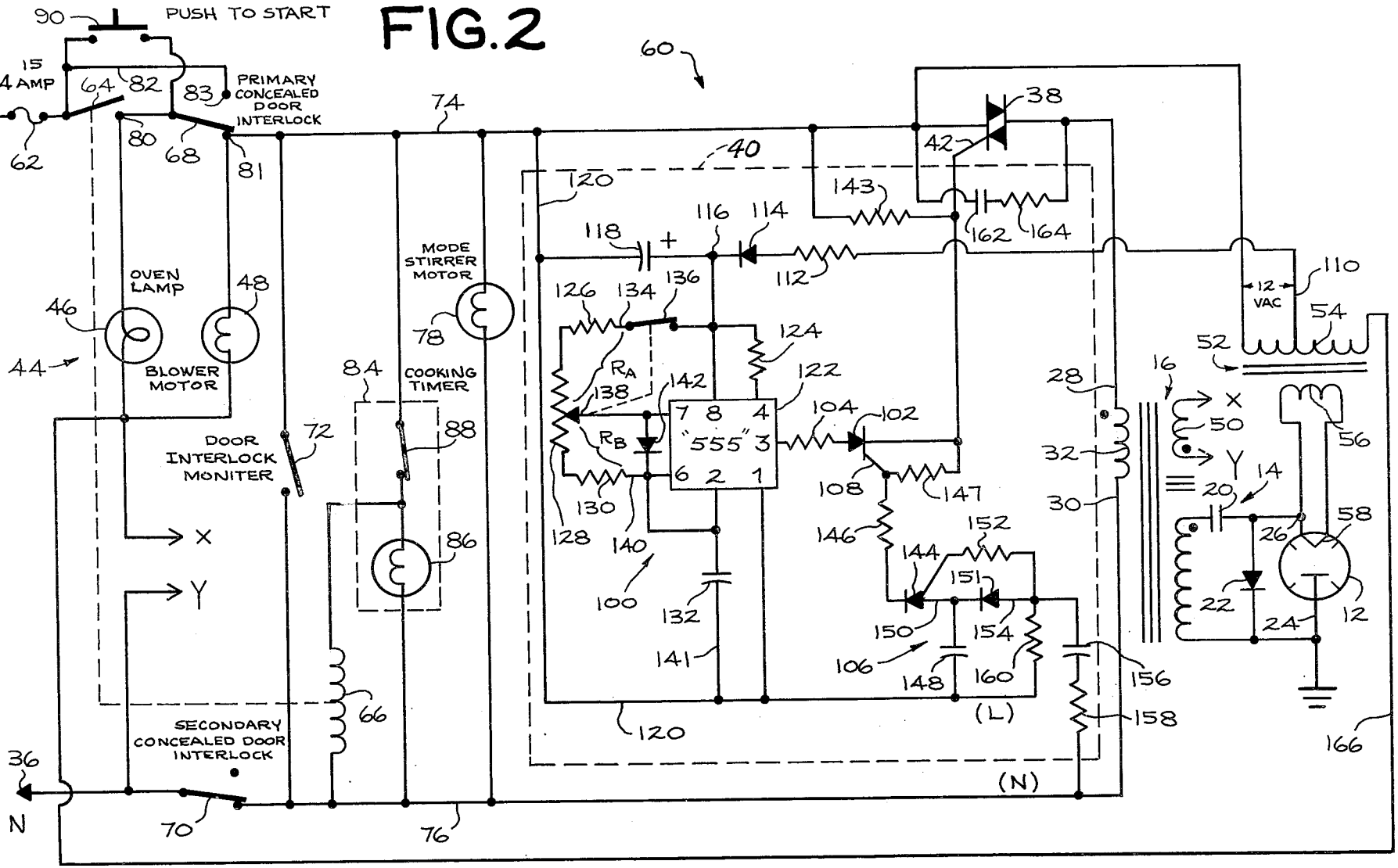
FIG. 2 is a detailed schematic circuit diagram of a microwave oven illustrating in detail the manner in which the present invention cooperates with various other circuit elements.

Referring now to FIG. 2, there is shown a more complete microwave oven circuit 60 illustrating in detail various other elements and a preferred manner incorporating the invention in a practical microwave oven. In general, the circuit 60 of FIG. 2 is basically unchanged with reference to the circuit 10 of FIG. 1, only adding details thereto. One exception is that in FIG. 2 the magnetron filament transformer 52 is also included in the constantly energized means 44.

In FIG. 2, the various switches and door interlocks are shown in their condition when the oven door is closed, time is set on the cooking timer, and the oven is not operating but is ready to start. The basic oven circuity includes a 15 amp protective fuse 62 interposed between the "L" power source terminal 34 and the remainder of the circuitry. A main power relay comprises a normally open contact 64 and a coil 66, with the relay contact 64 connected in series with the fuse 62. Primary and secondary safety interlock switches 68 and 70 associated with the door latch mechanism (not shown) complete a connection from the "L" and "N" power source terminals 34 and 36 to oven power conductors 74 and 76 when the oven door (not shown) is closed. To guard against a failure of the interlocks 68 and 70 or a user attempt to defeat the interlocks, a door interlock monitor switch 72 associated with the door hinge mechanism (not shown) is connected across the power conductors 74 and 76 to effectively short-circuit the power source through the fuse 62, thereby causing the fuse to "blow," if the monitor switch 72 senses the door is open at the same time the primary interlocks 68 and 70 indicate the door is closed. The terminals of a conventional low-speed mode stirrer mode 78 are connected across the power conductors 74 and 76 so as to be energized when the oven is operating.

The oven lamp 46 is connected between the normally open power relay contact 80 and the "N" power source terminal 36 (through the low voltage secondary winding 50 in accordance with the invention). Similarly, the blower motor 48 is connected between the normally open interlock contact 81 and the "N" power source terminal 36. When the primary concealed door interlock 68 is in the door closed position shown, the oven lamp 46 and the blower motor 48 are effectively in parallel. The particular connection of the lamp 46 permits it (but not the blower motor 48) to be energized through a conductor 82 and the normally closed interlock switch contact 83 when the oven door is open, even though the power relay contact 64 is open.

The basic control circuitry of the oven additionally includes a manually presettable cooking timer 84 which has a clock type motor 86 and a cam operated contact 88 which opens when a preset time has elapsed. The timer contact 88 and timer motor 86 are serially connected between the power conductors 74 and 76. Additionally, the power relay coil 66 is connected in parallel with the timer motor 86 so as to be energized simultaneously therewith whenever voltage is available across the power conductors 74 and 76 and the timer contact 88 is closed. Finally, in a "latch-on" arrangement, a momentary push-to-start switch 90 is connected by bypass the power relay contact 64. Assuming the primary interlock 68 is in the door closed position shown and the timer contact 88 is closed, momentary operation of the push-to-start switch 90 supplies the power conductor 74 and the relay coil 66, causing the power relay contact 64 to close. Voltage is then maintained across the conductors 74 and 76 until such time as the preset cooking time has elapsed and the timer contact 88 opens.

FIG. 2 additionally shows, within the dash lines, exemplary details for the triggering circuitry 40 which, together with the triac 38, comprises a preferred variable duty cycle solid state power level control. The triggering circuitry 40 includes three basic elements: a variable duty cycle square wave oscillator 100 which determines the duty cycle and thus power level of the microwave oven, a gate/latch SCR 102 serially connected through a resistor 104 between the output of the variable duty cycle oscillator 100 and the triac gate terminal 42, and a peak detector circuit 106 which supplies a momentary pulse to the gate 106 of the gate/-latch SCR 102 just after every positive peak of the incoming AC waveform.

Power for the triggering circuity 40 is derived from a twelve volt AC tap 110 on the primary of the magnetron filament transformer 52, which tap 110 operates in autotransformer fashion. A simple power supply comprising a current limiting resistor 112 and a series rectifier diode 114 supplies approximately 15 volts DC to a positive DC supply terminal 116. A filter capacitor 118 is connected between the DC supply terminal 116 and a circuit reference conductor 120, which also is connected to the power conductor 74. Thus the reference conductor 120 for the triac triggering circuitry 40 is not connected to "ground" as such, but rather is ultimately connected to the "L" power source terminal 34.

The variable duty cycle square wave oscillator 100 comprises an astable multivibrator built around a "555" IC timer 122. Connections shown for the timer 122 are those for an eight pin, dual inline IC package.

The positive DC supply pin 8 of the IC timer 122 is connected to the supply terminal 116, and the ground pin 1 is connected to the circuit reference conductor 120. Pin 4 is tied through a pull up resistor 124 to the positive DC supply terminal 116, as the function provided by pin 4 is not utilized in this particular circuit. Pin 3 is the output terminal.

A timing resistor 126, a user-variable potentiometer 128, a timing resistor 130 and a timing capacitor 132 are serially connected and together determine the period and duty cycle of the oscillator 100. The free terminal 134 of the upper timing resistor 126 is connected through a normally closed contact of a switch 136 to the positive DC supply terminal 116. The switch 136 is ganged with the movable potentiometer contact 138 and, when open, disables the timer 122 to provide constant "on," full power operation. The free terminal 140 of the lower timing resistor 130 is connected to sensing pins 6 and 2 of the IC timer 122, in addition to the capacitor 132. The lower terminal 141 of the capacitor 132 is connected to the reference conductor 120. To complete the timer circuit, the movable potentiometer contact 138 is connected to the "discharge" pin 7 of the IC timer 122, and a current bypass diode 142 is connected between the movable potentiometer contact 138 and the terminal 140 of the resistor 130.

As an aid to understanding the operation of the oscillator 100, the upper timing resistor 126 and that portion of the potentiometer 128 which is above the movable contact 138 together are designated $R_A$; the lower timing resistor 130 and that portion of the potentiometer 128 which is below the movable contact 138 together are designated $R_B$.

In operation the "555" IC 122, through its pins 2 and 6, senses the voltage on the timing capacitor 132. Depending upon the voltage so sensed, the "555" IC either permits "discharge" pin 7 to float or internally grounds pin 7. When pin 7 is floating, capacitor 132 charges through the resistance $R_A$ and the bypass diode 142 toward the potential at the positive DC supply terminal 116. When the voltage on the capacitor 132 reaches two-thirds of the DC supply voltage, pin 7 goes to ground and the capacitor 132 discharges through the resistance $R_B$. To provide an output at the same time, the internal arrangement of the IC is such that the voltage at the output pin 3 goes up and down in synchronism with "discharge" pin 7. As a result, the $R_A$ C time constant determines the length of the "on" period and the $R_B$ C time constant determines the length of the "off" period. By moving the position of the potentiometer movable contact 138, the user varies the percentage of "on" time to "off" time and thereby varies the ultimate power level through further connections hereinafter described.

The gate/latch SCR 102, when gated, permits the output of the square wave oscillator 100 to be supplied to the triac gate terminal 42. This triggers the triac 38 into conduction thereby energizing the magnetron power transformer 16 until such time as the timer output goes "low," removing the source of gating signal for the triac 38, which then turns off at the first moment the instantaneous current goes to zero. A resistor 143 connected between the power conductor 74 and the triac gate 42 improves the triac gate turn on characteristics and provides better gate noise immunity.

In order to minimize current stages which could result when power is first applied to the inductive load presented by the power transformer primary winding 32, the peak detector circuit 106 implements a synchronous switching technique whereby gating signals are initially supplied to the triac only in coincidence with an approximate positive peak of the incoming AC voltage waveform. This corresponds to an instant of approximately zero current. The result is that the transformer primary winding 32 is supplied with bursts of AC power, each burst being up to approximately 1 or 2 seconds in duration, depending upon the setting of the potentiometer 128, and comprising one or more complete half-cycles of AC current.

The peak detector circuit 106 comprises a complimentary SCR 144 having its cathode connected through a resistor 146 to the gate 108 of the gate/latch SCR 102. A resistor 147 connected between the gate 108 and cathode of the gate/latch SCR 102 serves to improve gate turn on characteristics and to improve gate noise immunity. A capacitor 148 is connected between the anode 150 of the SCR 144 and the circuit reference conductor 120. As previously mentioned, the circuit reference conductor 120 is also connected to the "L" power source terminal 34. A charging path diode 151 has its cathode connected to the junction of the capacitor 148 and the SCR anode 150. A resistor 152 parallels the diode 151. The anode 154 of the diode 151 is connected through a phase shift network comprising a capacitor 156 and a resistor 150 to the "N" power source terminal 36. To complete the phase shift network, a resistor 160 is connected between the diode anode 154 and the circuit reference conductor 120 and thereby to the "L" power source terminal 34.

In the operation of this portion of the circuit, during every cycle of the incoming AC voltage waveform, when the "N" power source terminal 36 is instantaneously positive with respect to the "L" power source terminal 34, the capacitor 148 charges through the resistor 158, the capacitor 156, and the diode 151. Due to the forward voltage drop of the diode 151, the gate of the SCR 144 is supplied with a slightly higher positive potential through the resistor 152 and the SCR gate-anode junction is reverse biased. Just after the instantaneous line voltage has passed its peak value and begins to decrease, the diode 151 becomes reversed biased and ceases conducting. The capacitor 148 remains charged, maintaining voltage on the SCR anode 150. At this same time the gate voltage supplied through the resistor 152 is decreasing. The gate-anode junction of the SCR 144 becomes forward biased, causing SCR 144 to conduct and to discharge the capacitor 148 into the gate 108 of the gate/latch SCR 102. As a result, the gate/latch SCR 102 can only permit the triac 38 to be triggered into conduction by the timer output in coincidence with a pulse from the peak detector circuit 106. A slight phase shift provided by the resistors 158 and 160 and the capacitor 156 was found necessary to optimize the operation of the circuit to minimize current surges.

To complete the circuit, a protective network comprising a capacitor 162 and a series resistor 164 is connected across the main terminals of the triac 38. This network also improves commutation of the triac 38, which is beneficial due to the inductive load presented by the primary winding 32.

As thus far described, the circuit 60 of FIG. 2 is consistent with the circuit 10 of FIG. 1. In the circuit of FIG. 2, there is one difference and that is that the primary winding 54 of the filament transformer 52 is effectively connected in parallel with the oven lamp 46 and the blower motor 48 so as to be included in the constantly energized means 44 for which it is desirable to minimize voltage variations. This is accomplished through a conductor 166 which connects the right hand terminal of the primary winding 54 back to the lower junction of the oven lamp 46 and the blower motor 48, effectively in series with the low voltage secondary winding 50. Such connection is primarily for the purpose of minimizing variations of the twelve volts AC for the triac triggering circuitry 40, but it additionally has beneficial effects in the operation of the magnetron filament 58 itself.

Insofar as the present invention is concerned, the operation of FIG. 2 is essentially identical to FIG. 1 and will not further be described.

The following table lists component values which have been found to be suitable in the circuit of FIG. 2. It will be appreciated that these component values are exemplary only.

| Resistors | | Capacitors | |
|---|---|---|---|
| 104 | 100 ohms | 20 | .91 mfd. |
| 112 | 4.7 ohms | 118 | 400 mfd. |
| 124 | 1 K ohms | 132 | 10 mfd. |
| 126 | 33 K ohms | 148 | .1 mfd. |
| 128 | 250 K ohms | 156 | .1 mfd. |
| 130 | 12 K ohms | 162 | .1 mfd. |
| 143 | 1 K ohms | | |

-continued

| | |
|---|---|
| 146 | 8.2K ohms |
| 147 | 1 K ohms |
| 152 | 220 K ohms |
| 158 | 56 K ohms |
| 160 | 5.6K ohms |
| 164 | 150 ohms |

| Diodes | Triac and SCR's | IC Timer |
|---|---|---|
| 22 Shindengen SRM-8Z | 38 G.E. SC160DX4 | 122 Fairchild |
| 154 1N4001 | 102 G.E. C103A | μA555TC |
| 142 1N4001 | 144 G.E. C13Y | or equivalent |
| 151 1N4001 | | |

It will be apparent therefore that the present invention provides an effective and inexpensive means for minimizing the voltage variations which occur as a result of the variable loading on the AC power source as the duty cycle power level control cycles the magnetron power transformer 16 on and off. The voltage, which would otherwise vary, is supplied to various constantly energized devices in the microwave oven such as the oven lamp, the blower motor, and the magnetron filament transformer. As a result, the effects known as lamp flicker and blower speed variation are minimized with very little additional cost.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A microwave oven circuit comprising:

a power transformer connected to energize a magnetron;

a duty cycle controlled switching element connected to periodically energize said power transformer from an AC power source which supplies voltage and current, the voltage available from the AC power source dropping slightly during those intervals when said power transformer is energized and loads the power source;

means including at least one load device energized constantly from the AC power source for which it is desirable to minimize voltage variations; and a low voltage secondary winding on the power transformer connected in series with said constantly energized means and phased to provide a voltage boost to said constantly energized means upon energization of the power transformer, thereby to approximately compensate for the drop in available AC voltage.

2. The microwave oven circuit of claim 1, wherein said constantly energized means includes an oven lamp.

3. The microwave oven circuit of claim 1, wherein said constantly energized means includes a blower motor.

4. The microwave oven circuit of claim 3, wherein said constantly energized means further includes a magnetron filament transformer.

5. A microwave oven circuit according to claim 1 adapted for connection to a nominal 117 volt household AC power source and wherein said low voltage secondary winding supplies approximately 3.3 volts AC when energized.

* * * * *